United States Patent [19]

Oguni et al.

[11] 4,227,442

[45] Oct. 14, 1980

[54] CYLINDER CONTROL DEVICE OF HYDRAULIC CYLINDER APPARATUS

[75] Inventors: Hiroshi Oguni, Akashi; Masahiro Ishiko, Miki; Kazuyoshi Nakayama, Kobe, all of Japan

[73] Assignee: Kawasaki Jukogyo Kabushiki Kaisha, Kobe, Japan

[21] Appl. No.: 60,541

[22] Filed: Jul. 25, 1979

[30] Foreign Application Priority Data

Jul. 29, 1978 [JP] Japan ..... 53-93009

[51] Int. Cl.[3] ..... F15B 15/22

[52] U.S. Cl. ..... 91/392

[58] Field of Search ..... 91/392, 394–399, 91/403, 410, 1

[56] References Cited

U.S. PATENT DOCUMENTS

| | | | |
|---|---|---|---|
| 3,626,807 | 12/1971 | Shartzer | 91/1 |
| 3,655,315 | 4/1972 | Bopp | 91/394 X |
| 4,022,269 | 5/1977 | Segawa | 91/392 X |
| 4,121,618 | 10/1978 | Sweeney | 91/410 X |

*Primary Examiner*—Leonard D. Christian
*Attorney, Agent, or Firm*—Jordan and Hamburg

[57] ABSTRACT

A cylinder control device of a hydraulic cylinder apparatus including a two-position, directional control valve having a pilot chamber for effecting control of reversal of the direction of movement of a piston, and a control valve movable between two positions depending on the pressure of working fluid in a conduit on the pump side. The control valve is mounted in a passage connecting the pilot chamber of the two-position, directional control valve to a valve means capable of bringing the pilot chamber into communication with conduit on the fluid discharging tank side when the cylinder piston reaches a predetermined position in its rearward stroke. Alternatively, the control valve may be mounted in a passage connecting the pilot chamber of the two-position, directional control valve to another valve means capable of bringing the pilot chamber into communication with the conduit on the pump side when the cylinder piston reaches the end of its forward stroke.

10 Claims, 6 Drawing Figures

CYLINDER CONTROL DEVICE OF HYDRAULIC CYLINDER APPARATUS

BACKGROUND OF THE INVENTION

This invention relates to a cylinder control device of a hydraulic cylinder apparatus, particularly a hydraulic cylinder apparatus having a load applied thereto near the end of the stroke of its piston.

In a hydraulic cylinder apparatus, the work done by a piston is given by the product of the working stroke of the piston, the effective pressure bearing area of the piston and the pressure of fluid acting on the piston. In a hydraulic cylinder apparatus of the prior art, difficulties have been encountered in maintaining the pressure in a working chamber defined by the piston and the cylinder body at a high level during the entire stroke of the piston, and thus it has been difficult to cause the piston to perform work of a high magnitude. Since the effective fluid pressure in the working chamber is produced by the load applied to the piston, the effective fluid pressure may be only produced near the dead point in the case of a hydraulic cylinder apparatus of the type wherein a load is applied to the piston near its dead point. Thus it is particularly difficult to cause a pressure of high level to be produced in the working chamber through the entire stroke of the piston in the case of the hydraulic cylinder apparatus of the aforesaid type.

SUMMARY OF THE INVENTION

An object of this invention is to provide a cylinder control device of a hydraulic cylinder apparatus capable of raising the pressure in the working fluid chamber of the cylinder body to a higher level than in hydraulic cylinder apparatus of the prior art, thereby enabling the hydraulic cylinder apparatus to perform work of a higher magnitude.

Another object is to provide a cylinder control device of a hydraulic cylinder apparatus capable of increasing the pressure in the working fluid chamber in spite of the fact that the working fluid source has a low capacity.

Still another object is to provide a cylinder control device of a hydraulic cylinder apparatus wherein the pressure in the working fluid chamber can be kept at a high level at all times by the arrangement whereby a stroke of the piston in one direction starts when the pressure in the conduit for supplying working fluid therethrough to the working fluid chamber has risen or, stated differently, the stroke of the piston in one direction does not commence unless the pressure in the conduit rises.

According to the present invention, there is provided a cylinder control device of a hydraulic cylinder apparatus comprising a cylinder body, a piston arranged in the cylinder body for reciprocatory movement, a plurality of working fluid chambers defined by the cylinder body and piston, a working fluid source, and a plurality of conduits for supplying working fluid from the working fluid source to the working fluid chambers and discharging working fluid from the working chambers to a fluid discharging place of a working fluid circuit, the cylinder control device comprising a two-position, directional control valve operative to control the supply of working fluid to the working fluid chambers and the discharge of working fluid therefrom to thereby switch the movement of the piston from one direction to the other direction, the two-position, directional control valve having a pilot chamber containting working fluid therein for moving the two-position, directional control valve between two positions when a change occurs in the pressure of working fluid in the pilot chamber which is connected to the fluid discharging place of the working fluid circuit; and a control valve connected to the pilot chamber of the two-position, directional control valve and movable between two positions or open and closed positions for causing the pressure in the pilot chamber to vary, the control valve being moved between the closed position and the open position by a change in the pressure in the conduit in communication with the working fluid source, and the pressure in the conduit in communication with the working fluid source being raised when the piston is in one end position to move the control valve from one position to the other position, thereby causing the pressure in the pilot chamber to vary and moving the two-position, directional control valve from one position to the other position.

In the cylindrical control device of a hydraulic cylinder apparatus according to the present invention, the control valve moves from one position to the other position only when the pressure in the conduit in communication with the working fluid source rises to a predetermined level to thereby raise the pressure of the working fluid so that working fluid of increased pressure is supplied to the working chambers in the cylinder body, to thereby move the piston in one stroke in one direction. By this arrangement, the pressure in the working chamber is maintained at a high level from the time the piston starts its stroke, so that the piston can perform work of a high magnitude. That is, when the piston starts its stroke in one direction, the conduit through which working fluid is supplied to the working fluid chamber has its pressure increased, thereby ensuring that the pressure in the working fluid chamber is kept at a high level.

Additional and other objects, features and advantages of the present invention will become apparent from the description of the embodiments set forth hereinafter when considered in conjunction with the accompanying drawings.

DESCRIPTION OF THE PREFERRED EMBODIMENTS

The drawings illustrate hydraulic cylinder apparatus controlled by the cylinder control device provided by the present invention. The hydraulic cylinder apparatus is operated by working fluid supplied from a working fluid source of a working fluid circuit.

Figure 1:
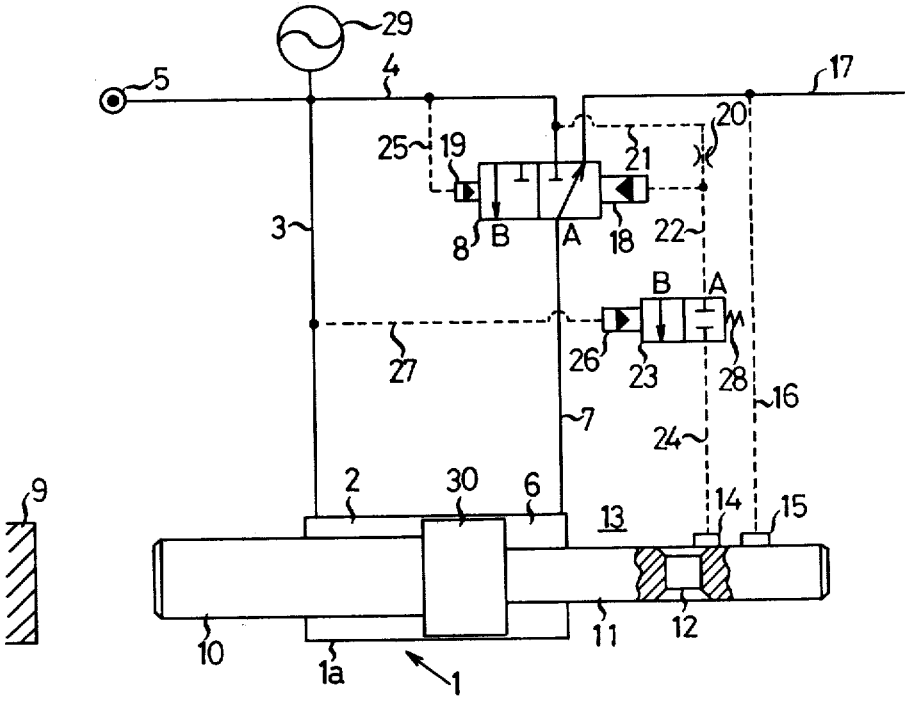
FIG. 1 is a circuit diagram of the hydraulic cylinder apparatus including a cylinder control device comprising one embodiment of the present invention wherein a maximum kinetic energy is produced when the piston moves leftwardly.

In FIG. 1, the numeral 1 designates a differential pressure hydraulic cylinder comprising a cylinder body 1a, and a piston 30 movable in reciprocatory movement in the cylinder body 1a. In this embodiment, the hydraulic cylinder 1 is in the form of a double-acting cylinder of the double rod type. The cylinder body 1a and piston 30 define working fluid chambers 2 and 6, one working fluid chamber 2 being connected through main conduits 3 and 4 to a working fluid source 5 having a pump, now shown, and the other working fluid chamber 6 being connected to the working fluid source 5 through a main conduit 7, a three-port, two-position, directional control valve 8 and the main conduit 4. Working fluid is supplied to and discharged from each working fluid chamber through the main conduits. The piston 30 has piston rods 10 and 11 attached to opposite ends thereof. The piston rod 10 adapted to strike an object 9 has a larger diameter than the piston rod 11 formed with an annular groove 12 at its forward end portion. Fluid chambers 14 and 15 are located in spaced relation on the wall of a piston inserting hole formed in a casing 13 surrounding the piston rods 10 and 11. The annular groove 12 maintains the fluid chambers 14 and 15 in communication with each other when the piston 30 has moved to its upper limit position (right end position in FIG. 1), so that the fluid chamber 14 is communicated with a fluid discharging place (or a tank, not shown) of the working fluid circuit through the annular groove 12, fluid chamber 15, a passage 16 and a return passage 17. The passage 16 is connected to the return passage 17 and the return passage 17 is connected to the two-position, directional control valve 8. The spacing interval between the fluid chambers 14 and 15 is equal to the width of the annular groove 12. The fluid chambers 14 and 15 and annular groove 12 constitute first valve means.

The two-position, directional control valve 8 has two pilot chambers 18 and 19 differing from each other in pressure bearing area. The pilot chamber 18 of larger pressure bearing area is connected to the main conduit 4 by way of a passage 21 mounting a restrictor or a throttle 20, and to the fluid chamber 14 by way of a passage 22, a two-port, two-position, control valve 23 and a passage 24. The pilot chamber 19 of smaller pressure bearing area is connected to the main conduit 4 by way of a passage 25. When no woking fluid acts in the pilot chamber 18, the two-position, directional control valve 8 moves to a functional position B; when working fluid acts in the pilt chamber 18, the two-position, directional control valve 8 moves to a functional position A. It is to be understood that the pilot chamber 19 of smaller pressure bearing area may be replaced by a spring. The control valve 23 has a pilot chamber 26 connected via a branch conduit 27 to the main conduit 3, and operates such that when pressure of working fluid in the main conduit 3 exceeds a set pressure of a spring 28 of the control valve 23, the valve 23 communicates the passages 22 and 24 with each other. The numeral 29 designates an accumulator.

The embodiment of the invention constructed as aforesaid operates as follows. When the two-position, directional control valve 8 has been moved to the functional position A by the pressure of the working fluid in the pilot chamber 18 to permit the piston 30 to move rightwardly to its original position as shown in FIG. 1, the pressure of the working fluid in the main conduit 3 is lower than the set pressure of spring 28 of the control valve 23, so that the control valve 23 is in its functional position A and no comuunication is maintained between the two passages 22 and 24. Upon the piston 30 reaching its upper limit position (right end position in FIG. 1), the annular groove 12 brings the fluid chambers 14 and 15 into communication with each other, so that passage 24 communicates with the tank at the discharge side of the working fluid circuit. The two-position, directional control valve 8 is still in functional position A because communication between the two passages 24 and 22 is cut off by the control valve 23. Thus the piston 30 stops in its upper limit position, and working fluid from the working fluid source 5 is stored in the accumulator 29, so that the pressure of the working fluid in the conduits 3, 4 and 27 in communication with the working fluid source 5 gradually increases. When the pressure of the working fluid exceeds the set pressure of spring 28 of the control valve 23, the control valve 23 moves to its functional position B to thereby bring the pilot chamber 18 of the two-position, directional control valve 8 into communication with the tank at the discharge end of the working fluid circuit. This moves the two-position, directional control valve 8 to its functional position B. Thus the working fluid of high pressure in the main conduits 3 and 4 is supplied to the working fluid chambers 2 and 6 of the cylinder body 1a and the working fluid of high pressure is applied to opposite ends of the piston 30. Since the two ends of the piston 30 differ from each other in effective pressure bearing area, the piston 30 moves from its upper limit position to its lower limit position (leftwardly in FIG. 1). At this time, the action of the working fluid in the main conduits 3 and 4 is increased by the working fluid in the accumulator 29, and the pressure in the working chambers 2 and 6 is very high, so that when the pisotn rod 10 vigorously impinges against the object 9 near the lower limit of its stroke, work of high magnitude can be done by the hydraulic cylinder apparatus. When the piston 30 moves leftwardly, communication between the fluid chambers 14 and 15 is cut off as soon as the annular groove 12 is released from the fluid chamber 15, and the working fluid is introduced into the pilot chamber 18 of the two-position, directional control valve 8 by way of the restrictor 20 to gradually increase the pressure in the pilot chamber 18. The restrictor 20 is adjusted such that when the piston rod 10 vigorously impinges against the object 9, a force overcoming the pressure in the pilot chamber 19 acts in the pilot chamber 18. Thus, as the piston rod 10 vigorously impinges against the object 9, the two-position, directional control valve 8 moves to its functional position A to bring the working fluid chamber 6 into communication with the tank at the discharge side of the working fluid circuit. This causes the piston 30 to move rightwardly in FIG. 1 to its original position. In this way, the piston 30 is moved in opposite directions by the working fluid. When the piston 30 moves rightwardly, the pressure of the working fluid on the pump side is slightly lower than when the piston 30 moves leftwardly but kept at a relatively high level. The control valve 23 is restored to its functional position A when the piston 30 makes one reciprocatory movement from its upper limit position and before it reaches its upper limit position, because the pressure in the main conduit 3 is reduced to a level below that of the set pressure of spring 28.

According to the present invention, the control valve 23 brought to its open position by a predetermined pressure of the working fluid in the main conduit 3 and the first valve means brought to its open position when the piston 30 moves to its upper limit position are mounted in series between the pilot chamber 18 of the two-posiition, directional control valve 8 and the passage 16 communicating with the return cnduit 17. The movement of the piston 30 to its upper limit position is detected by the first valve means, and a rise of the pressure of the working fluid in the main conduit 3 to a predetermined level is detected by the control valve 23, so as to switch the control valve 23 from one position to the other position, to thereby switch the two-position, directional control valve 8 from one position to the other position. Thus working fluid of high pressure is supplied to the working fluid chambers 2 and 6 in the cylinder body 1*a* to drive the piston 30 by the working fluid of high pressure. By adjusting the set pressure of the spring 28 of the control valve 23, it is possible to adjust the pressure of the working fluid in the main conduit 3 which switches the control valve 23 from one position to the other position. Thus the pressure of working fluid acting on the piston 30 can be essentially selected at any level as desired. The fluid cylinder apparatus shown in FIG. 1 is of the double-acting hydraulic cylinder of the double-rod type, so that is is possible to raise the pressure of the working fluid in the working chambers 2 and 6 to a substantially high level by means of a pump of a relatively small capacity even if the accumulator 29 is dispensed with. This makes it possible to impart kinetic energy of high level to the piston 30.

Figure 2:
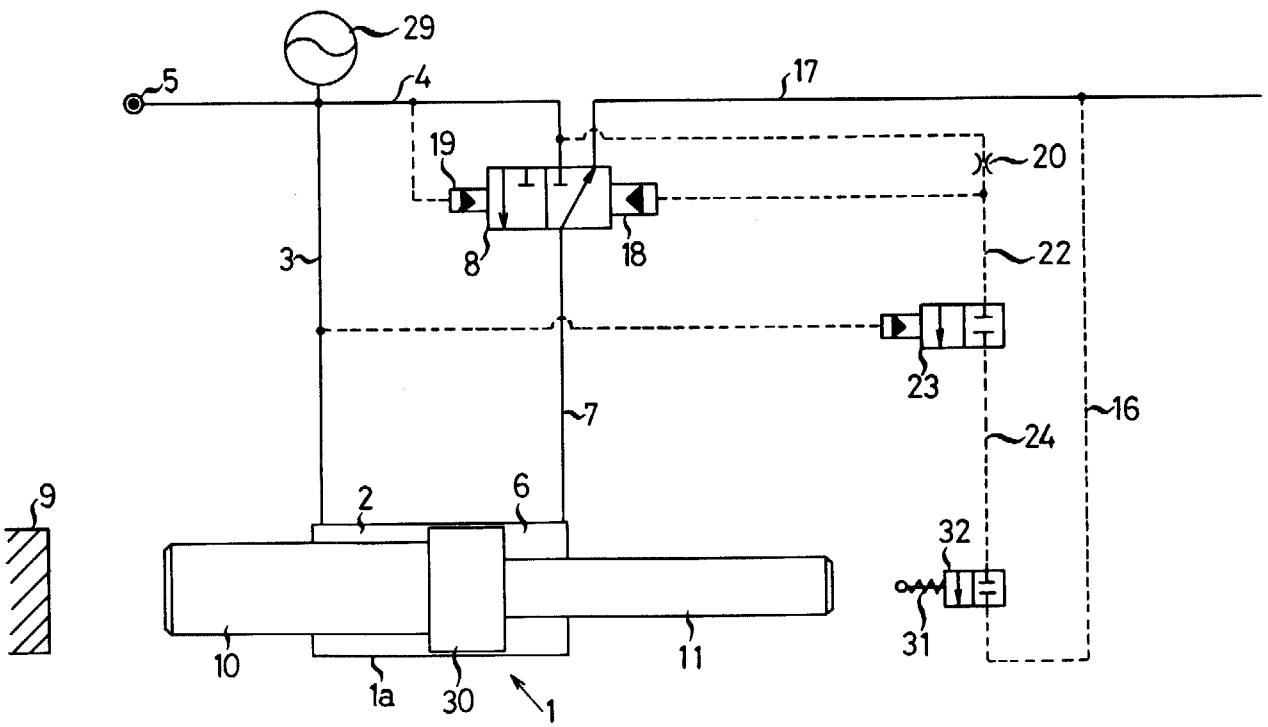
FIGS. 2, 3 and 4 are circuit diagrams of modifications of the hydraulic cylinder apparatus shown in FIG. 1.

FIGS. 2 to 6 show other embodiments of the invention wherein parts similar to those shown in FIG. 1 are designated by like reference characters. The embodiment shown in FIG. 2 comprises a two-port, two-position, directional control valve 32 having a detector rod 31 for detecing the end of the piston rod 11 and bringing the valve 32 to an poen position, in place of the first valve means of the embodiment shown in FIG. 1 including the annular groove 12 and the fluid chambers 14 and 15. The two-port, two-position, directional control valve 32 acting as a first valve means is interposed between the passages 16 and 24. Other parts of the embodiment shown in FIG. 2 are similar to those of the embodiment shown in FIG. 1, and the embodiment shown in FIG. 2 operates in the same manner as the embodiment shown in FIG. 1.

Figure 3:
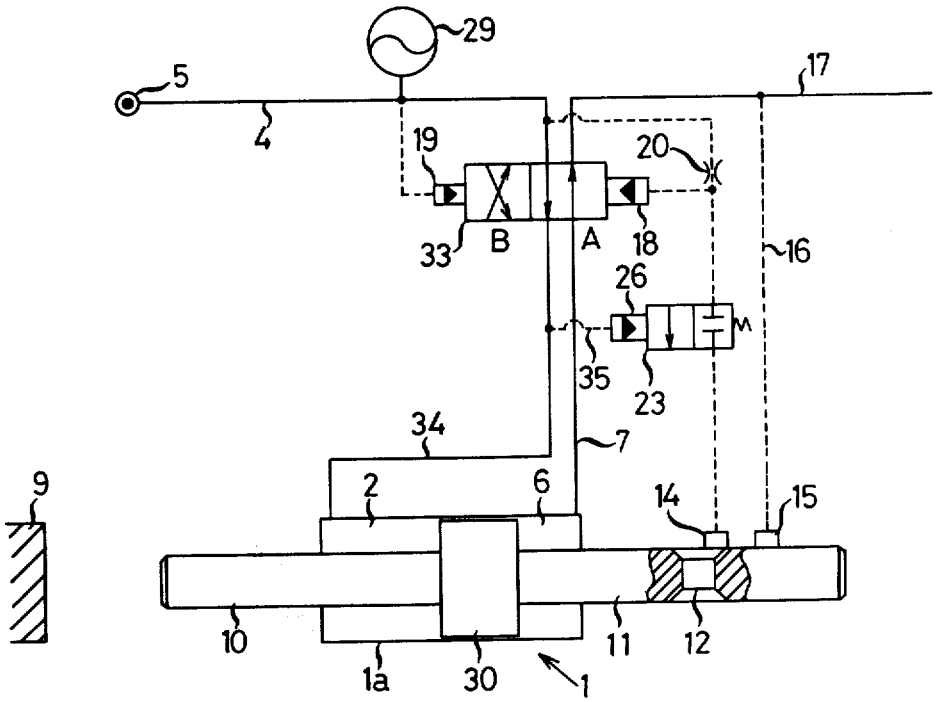

In the embodiment shown in FIG. 3, a four-port, two-position, directional control valve 33 is used in place of the three-port, two-position, directional control valve 8 shown in FIG. 1, and the pilot chamber 26 of the control valve 23 is connected, via a branch conduit 35, to a main conduit 34 connecting the working fluid chamber 2 to the two-position, directional control valve 33. By this arrangement, when the piston 30 moves rightwardly as shown, the two-position, directional control valve 33 is in its functional position A, to thereby supply working fluid from the working fluid source 5 to the working fluid chamber 2 via the dirctional two-position, control valve 33 and to discharge working fluid from the working fluid chamber 6 via the main conduit 7, two-position, directional control valve 33, and return conduit 17. When the piston 30 moves leftwardly, the two-position, directional control valve 33 moves to its functional position B in the same manner as the two-position, directional control valve 8 shown in FIG. 1. This permit working fluid to be supplied from the working fluid source 5 to the working fluid chamber 6 via the two-position, directional control valve 33, and allows the working fluid in the working fluid chamber 6 to be discharged via the main conduit 7, the two-position, directional control valve 33 and return conduit 17 to the tank on the discharge side of the working fluid circuit. Other parts of the embodiment shown in FIG. 3 and the operation of the embodiment are similar to those of the embodiment shown in FIG. 1.

Figure 4:
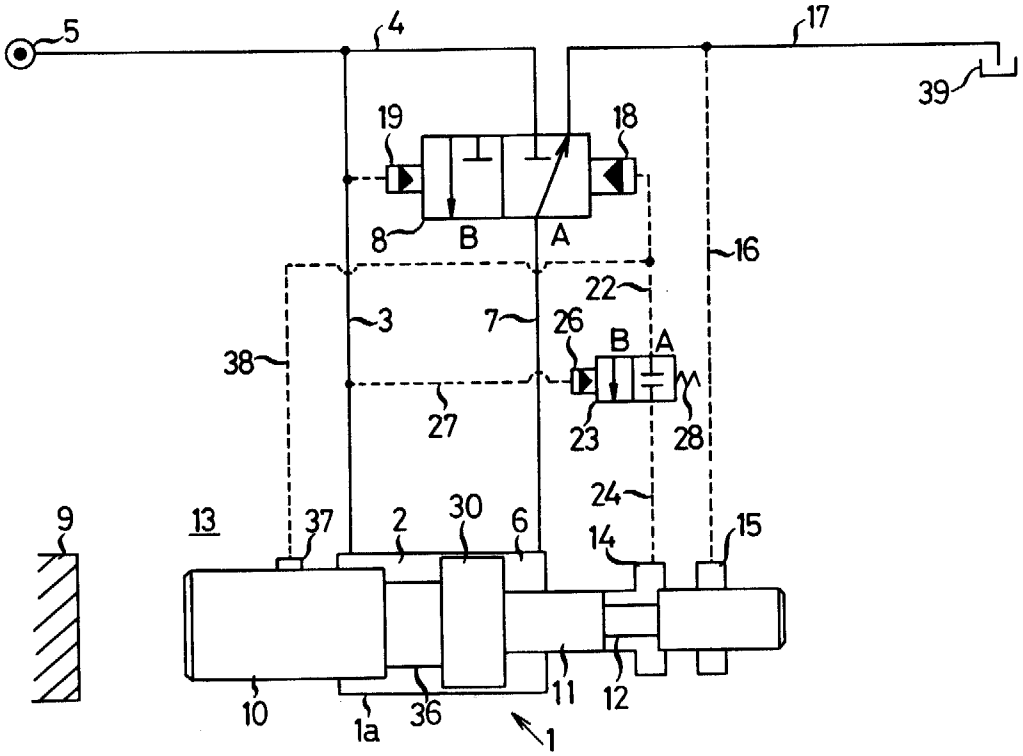

In the embodiment shown in FIG. 4, the passage 21 mounting the restrictor 20 therein as shown in FIG. 1 is dispensed with, while an annular groove 36 is formed at the base of the piston rod 10 and a working fluid chamber 37 communicating with the annular groove 36 when the piston 30 moves to the lower limit position is formed on the wall of the hole for inserting the piston rod 10 of the casing 13 surrounding the piston rod. The annular groove 36 and fluid chamber 37 constitute a second valve means. The fluid chamber 37 is maintained in communication with the passage 22 via a passage 38, to introduce working fluid to the pilot chamber 18 of the two-position, directional vontrol valve 8 when the piston 30 moves to its lower limit position. By this arrangement, when the piston 30 moves rightwardly as shown, the control valve 23 is closed, the fluid chamber 37 is closed by the piston rod 10, and the pilot chamber 18 of the two-position, directional control valve 8 is kept at a high pressure level to move the valve 8 to its functional position A. Thus the piston 30 can move rightwardly without any trouble, like the piston 30 of the embodiment shown in FIG. 1. Upon the piston 30 reaching the right end position, the fluid chambers 14 and 15 are brought into communication with each other by the annular groove 12 or the first valve means is opened. Then, the pressure in the main conduit 3 and the branch conduit 27 rises and brings the control valve 23 to its functional position B, with a result that the pilot chamber 18 is brought into communication with a tank 39 on the discharge side of the working fluid circuit via the fluid chamber 14, annular groove 12, fluid chamber 15 and return conduit 17. This causes the pressure in the pilot chamber 18 to be reduced and moves the two-position, directional control valve 8 to its functional position B. At this time, the pressure in the fluid chamber 37 is also reduced. The movement of the two-position, directional control valve 8 to its functional position B causes the piston 30 to move leftwardly in the same manner as in other embodiments shown and described. Upon the piston 30 reaching the lower limit position, the annular groove 36 brings the fluid chamber 37 and working fluid chamber 2 in communication with each other. Since the fluid chamber 14 is cut off from the fluid chamber 15 at this time, the pressure in the pilot chamber 18 rises and the two-position, directional control valve 8 is brought to its functional position A. This causes the piston 30 to start moving rightwardly. The embodiment shown in FIG. 4 has no accumulator like the one 29 shown in FIG. 1. However, when the piston 30 reaches the upper limit position at the right end, the pressure in the main conduit 3 and the branch conduit 27 can be raised to a sufficiently high level to bring the control valve 23 to its functional position B. Other parts of the embodiment shown in FIG. 4 and the operation of the embodiment are similar to those of the embodiment shown in FIG. 1.

Figure 5:
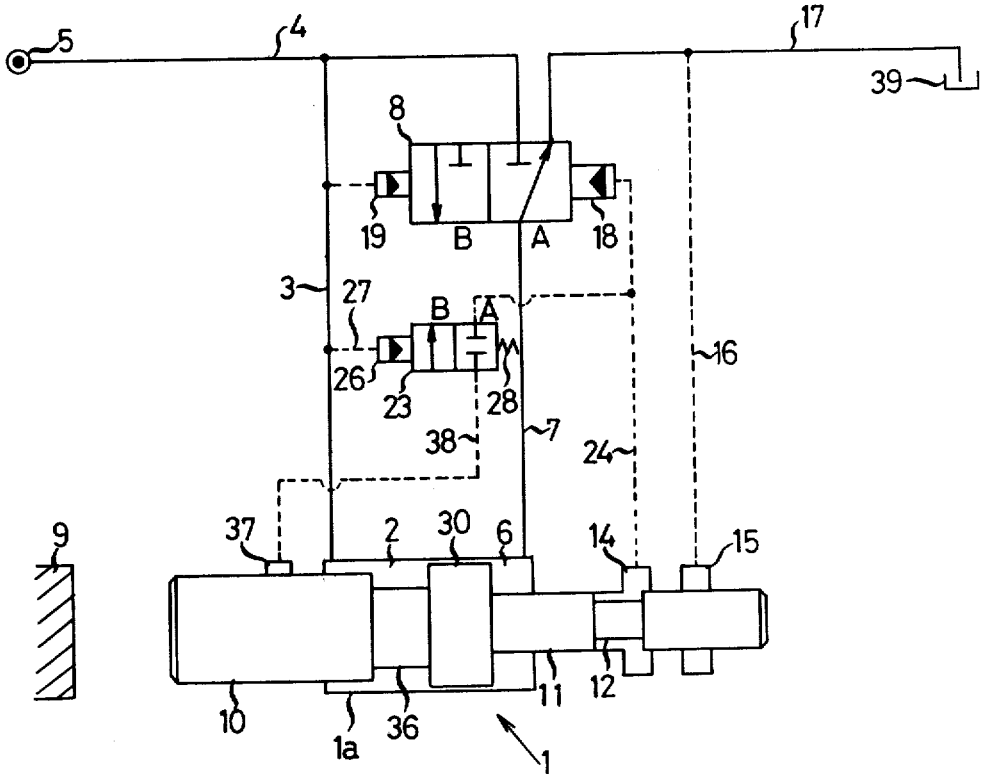
FIG. 5 is a circuit diagram of the hydraulic cylinder apparatus including a cylinder control device comprising another embodiment of the invention wherein maximum kinetic energy is produced when the piston moves rightwardly.

FIG. 5 shows a modification of the embodiment shown in FIG. 4 in which the control valve 23 is mounted in a passage 38. In this modification, when the two-position, directional control valve 8 is in its functional position A and the piston 30 reaches its upper limit position from the position shown in the figure in which the piston 30 is moving rightwardly, the first valve means opens or the annular groove 12 brings the fluid chambers 14 and 15 into communication with each other to bring the pilot chamber 18 into communication with the tank 39, so that the pressure in the pilot chamber 18 is reduced. This causes the valve 8 to move to its functional position B as soon as the piston 30 reaches its upper limit position, so that working fluid is supplied from the working fluid source 5 to the working fluid chamber 6. The difference in the pressure bearing area of the two ends of the piston 30 moves the piston 30 leftwardly in FIG. 5. As the piston 30 draws near the lower limit position, the fluid chamber 37 of the second valve means is brought into communication with the main conduit 3 by way of the annular groove 36 and working fluid chamber 2. However, since the control valve 23 is closed, the working fluid supplied by the pump from the working fluid source 5 does not act in the pilot chamber 18, so that the two-position, directional control valve 8 is still in its functional position B. When the piston 30 reaches the lower limit position and stops, the pressure in the main conduits 3, 4 and 7 rises. Upon the pressure of the working fluid in the main conduits 3, 4 and 7 exceeding the set pressure of spring 28 of the control valve 23, the control valve 23 is switched to its functional position B to introduce the working fluid in the main conduit 3 to the pilot chamber 18. This switches the two-position, directional control valve 8 to its functional position A, and the piston 30 is moved rightwardly by the working fluid of high pressure from the main conduit 3. The operation stated hereinabove is repeated when the hydraulic cylinder apparatus is actuated. In this embodiment, although the pressure of working fluid on the pump side is slightly reduced when the piston 30 moves leftwardly than when it commences its rightward movement, the pressure of working fluid acting on the piston 30 is kept at a considerably high level. Thus the embodiment shown in FIG. 5 is able to give relatively high kinetic energy to the piston 30 through its entire stroke, although the direction of the piston 30 is reversed from the piston 30 shown in the embodiment of FIG. 1.

Figure 6:
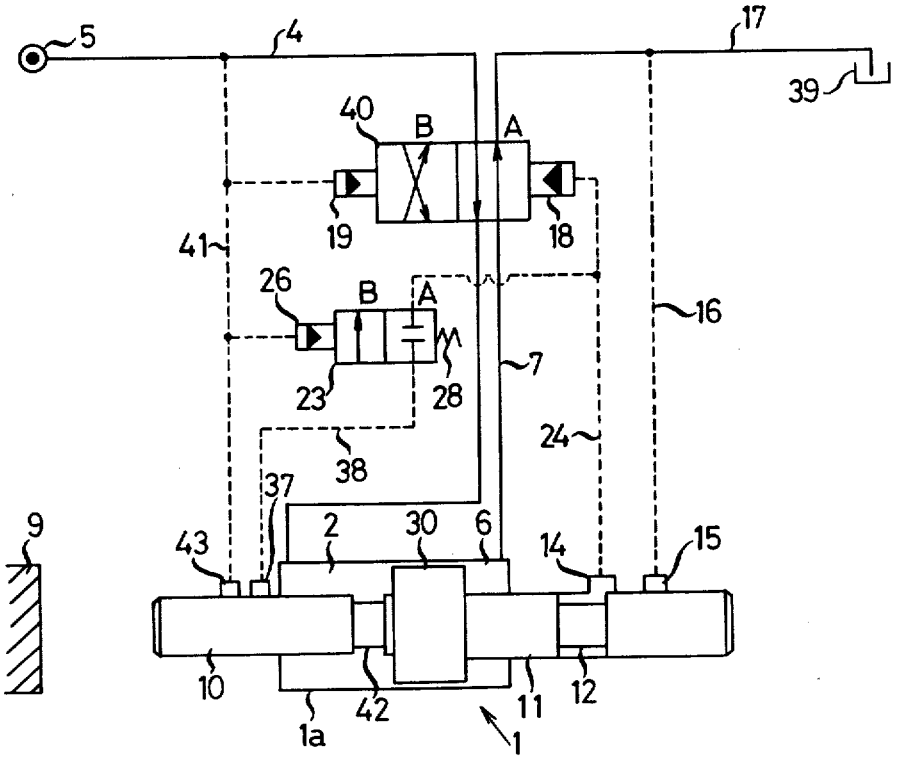
FIG. 6 is a circuit diagram of a modification of the hydraulic cylinder apparatus shown in FIG. 5.

FIG. 6 shows a modification of the embodiment shown in FIG. 5 wherein the three-port, two-position directional control valve 8 shown in FIG. 5 is replaced by a four-port, two-position, directional control valve 40, while a pump side fluid passage 41 for supplying a pilot pressure to the pilot chamber 19 of the two-position, directional control valve 40 and the pilot chamber 26 of the control valve 23 is connected to the main conduit 4 and a fluid chamber 43 formed in the casing. The fluid chamber 43 is brought into communication with the fluid chamber 37 formed in the casing via an annular groove 42 formed in the base of the piston rod 10 when the piston 30 reaches its lower limit position. The fluid chambers 43, 37 and the annular groove 42 constitute a second valve means. In this embodiment, when the two-position, directional control valve 40 is in its functional position A and the piston 30 reaches its upper limit position from the position shown in the figure in which the piston is moving rightwardly, the annular groove 12 brings the pilot chamber 18 into communication with the tank 39 to bring the two-position, directional control valve 40 to its functional position B and to move the piston 30 leftwardly in the figure. Upon the piston 30 drawing near its lower limit position, the fluid chamber 37 is first brought into communication with the working fluid chamber 2 via the annular groove 12. However, since the two-position, directional control valve 40 is in its functional position B, the working fluid chamber 2 is in communication with the tank 39 and the control valve 23 is closed. When the piston 30 reaches its lower limit position and stops, the annular groove 42 brings the fluid chambers 37 and 43 into communication with each other while the fluid chambers 37 and 43 are brought out of communication with the working fluid chamber 2, and the pressure of working fluid in the main conduits 4 and 7 and passage 41 rises. When the pressure of the working fluid exceeds the set pressure of spring 28 of the control valve 23, the control valve 23 moves to its functional position B, and the pressure of fluid on the pump side acts in the pilot chamber 18 via the passage 41, fluid chamber 43, annular groove 42, fluid chamber 37, passage 38 and control valve 23, to move the two-position, directional control valve 40 to its functional position A. As a result, the piston 30 is moved rightwardly by the working fluid of high pressure from the main conduit 4. It will be understood that the embodiment shown in FIG. 6 operates in the same way as the embodiment shown in FIG. 5.

As described hereinabove, in the embodiments shown in FIGS. 1 to 6, one pilot chamber of the two-position directional control valve for effecting control of the supply of working fluid to the cylinder piston and discharge of working fluid therefrom and valve means are connected together by way of a passage having mounted therein a control valve which uses the pressure of working fluid on the pump side as a pilot pressure. When the pressure of working fluid in the conduits communicating with the pump reaches a predetermined high level, the two-position, directional control valve is actuated so that the working fluid of high pressure causes the piston to communce its stroke in one direction. Thus it is possible to drive the piston by the working fluid of high pressure during its entire stroke. Also, by increasing the set pressure of a spring for the control valve as much as possible, it is possible to further increase the pressure of working fluid in the working fluid chambers by relatively simple and inexpensive means, thereby making it possible to impart increased kinetic energy to the cylinder piston.

What is claimed is:

1. A cylinder control device of a hydraulic cylinder apparatus comprising a cylinder body, a piston arranged in said cylinder body for reciprocatory movement, a plurality of working fluid chambers defined by the cylinder body and the piston, a working fluid source, and a plurality of conduits for supplying working fluid from the working fluid source to the working fluid chambers and discharging working fluid therefrom to a fluid discharging place of a working fluid circuit, the cylinder control device comprising:

a two-position, directional control valve operation to control the supply of working fluid to the working fluid chambers and the discharge of working fluid therefrom to thereby switch the movement of the piston from one direction to the other direction, the two-position, directional control valve having a pilot chamber containing working fluid therein for moving the two-position, directional control valve between two positions when a change occurs in the pressure of working fluid in the pilot chamber which is connected to the fluid discharging place of the working fluid circuit; and a control valve connected to the pilot chamber of said two-position, directional control valve and movable between two positions or open and closed positions for causing the pressure in the pilot chamber to vary, the control valve being moved between the closed position and the open position by a change in the pressure in the conduit in communication with the working fluid source, and the pressure in the conduit in communication with the working fluid source being raised when the piston is in one end position to move the control valve from one position to the other position, thereby causing the pressure in the pilot chamber to vary and moving the two-position, directional control valve from one position to the other position.

2. A cylinder control device of a hydraulic cylinder apparatus as set forth in claim 1, further comprising a first valve means interposed between the pilot chamber of the two-position, directional control valve and the fluid discharging place of the working fluid circuit, said first valve means being operative to open when the piston reaches a predetermined position in its rearward stroke.

3. A cylinder control device of a hydraulic cylinder apparatus as set forth in claim 2, wherein said control valve is located in a passage connecting the pilot chamber of the two-position, directional control valve to the first valve means, the pressure in the conduit in communication with the working fluid source being raised to move the control valve to the open position when the first valve means is open, thereby bringing the pilot chamber of the two-position, directional control valve into communication with the fluid discharging place of the working fluid circuit by way of the control valve and the first valve means and reducing the pressure in the pilot chamber, to move the two-position, directional control valve from one position to the other position.

4. A cylinder control device of a hydraulic cylinder apparatus as set forth in claim 1, further comprising a second valve means operative to open when the piston reaches the end of its forward stroke, the pressure in the pilot chamber being raised when the pilot chamber is brought into communication with the working fluid source by way of the second valve means to thereby move the two-position, directional control valve from one position to the other position.

5. A cylinder control device of a hydraulic cylinder apparatus as set forth in claim 4, wherein said control valve is located in a passage connecting the second valve means to the pilot chamber of the two-position, directional control valve, the pressure in the conduit of the working fluid circuit on the working fluid source side being raised to move the control valve to the open position when the second valve means is opened to bring the control valve into communication with the conduit of the working fluid circuit on the working fluid source side, thereby bringing the pilot chamber into communication with the conduit of the working fluid circuit on the working fluid source side and raising the pressure in the pilot chamber to move the two-position, directional control valve from one position to the other position.

6. A cylinder control device of a hydraulic cylinder apparatus as set forth in claim 2, wherein said hydraulic cylinder apparatus further comprises a piston rod means connected to the piston, and a casing surrounding said piston rod means, and wherein said first valve means operative to bring the pilot chamber of the two-position, directional control valve into communication with the fluid discharging place of the working fluid circuit comprises a groove formed in the piston rod means, and two fluid chambers located in spaced-apart relation on the wall of an opening formed in the casing for inserting the piston rod means, said two fluid chambers being brought out of communication with each other by the piston rod means to close the first valve means and being brought into communication with each other via said groove to open the first valve means, one of said fluid chambers being connected to the pilot chamber and the other fluid chamber being connected to the fluid discharging place of the working fluid circuit.

7. A cylinder control device of a hydraulic cylinder apparatus as set forth in claim 4, wherein said hydraulic cylinder apparatus further comprises a piston rod means connected to the piston, and a casing surrounding said piston rod, and wherein said second valve means operative to bring the pilot chamber of the two-position, directional control valve into communication with the conduit of the working fluid circuit on the working fluid source side comprises a groove formed in the piston rod means, and at least one fluid chamber formed on the wall of an opening formed in the casing for inserting the piston rod means, the second valve means being able to bring the pilot chamber into communiation with the conduit of the working fluid circuit on the working fluid source side via the fluid chamber when the second valve means is open and the second valve means being able to interrupt the communication between the pilot chamber and the conduit of the working fluid circuit on the working fluid source side by the action of the piston rod means when the second valve means is closed.

8. A cylinder control device of a hydraulic cylinder apparatus as set forth in claim 2, wherein said first valve means operative to bring the pilot chamber of the two-position, directional control valve into communication with the conduit of the working fluid circuit on the fluid discharging place side is in the form of a two-position, directional control valve moved to an open position when a detecting rod detects the end of a piston rod means connected to the piston.

9. A cylinder control device of a hydraulic cylinder apparatus as set forth in claim 1, further comprising an accumulator mounted in one of the conduits in communication with the working fluid source.

10. A cylinder control device of a hydraulic cylinder apparatus as set forth in claim 1, wherein the hydraulic cylinder apparatus is a double-acting cylinder apparatus of the double-rod type.

* * * * *